US006763769B2

(12) United States Patent
Ballendat

(10) Patent No.: US 6,763,769 B2
(45) Date of Patent: Jul. 20, 2004

(54) DROP-LEAF TABLE

(75) Inventor: Martin Ballendat, Altheim (AT)

(73) Assignee: Dauphin Entwicklungs- u. Beteiligungs-GmbH, Neukirchen (DE)

( * ) Notice: Subject to any disclaimer, the term of this patent is extended or adjusted under 35 U.S.C. 154(b) by 68 days.

(21) Appl. No.: 10/201,313

(22) Filed: Jul. 24, 2002

(65) Prior Publication Data

US 2003/0019405 A1 Jan. 30, 2003

(30) Foreign Application Priority Data

Jul. 24, 2001 (DE) ..... 101 35 921

(51) Int. Cl.[7] ..... A47B 1/04
(52) U.S. Cl. ..... 108/79; 108/77; 108/64
(58) Field of Search ..... 108/79, 77, 64, 108/59, 81, 87

(56) References Cited

U.S. PATENT DOCUMENTS

| | | | | | |
|---|---|---|---|---|---|
| 933,474 | A | * | 9/1909 | Lindow | 108/79 |
| 1,513,150 | A | * | 10/1924 | Beaudett | 108/79 |
| 1,953,655 | A | * | 4/1934 | Miller | 108/79 |
| 2,425,370 | A | | 8/1947 | Giberson | |
| 2,563,891 | A | * | 8/1951 | Wallace | 108/79 |
| 2,799,547 | A | * | 7/1957 | Larsen | 108/79 |
| 3,002,787 | A | * | 10/1961 | Ziegenfuss | 297/249 |
| 3,199,825 | A | | 8/1965 | Bellows | |
| 3,267,881 | A | * | 8/1966 | Saggione | 108/59 |
| 3,342,147 | A | * | 9/1967 | Shettles | 108/64 |
| 6,164,016 | A | | 12/2000 | Bue et al. | |
| 6,182,581 | B1 | * | 2/2001 | Boyce | 108/64 |
| 6,598,542 | B2 | * | 7/2003 | Goldberg et al. | 108/64 |

FOREIGN PATENT DOCUMENTS

| | | | |
|---|---|---|---|
| DE | 1 429 515 | | 10/1969 |
| DE | 2 209 034 | A | 12/1971 |
| FR | 1 116 697 | A | 5/1956 |
| GB | 2100121 | * | 5/1981 |

* cited by examiner

*Primary Examiner*—Jose V. Chen
(74) *Attorney, Agent, or Firm*—Browdy and Neimark, P.L.L.C.

(57) ABSTRACT

A drop-leaf table comprises a center leaf and two drop leaves, which are articulated to the center leaf by a hinge and mounted for pivoting into a dropped position and a position that is directed upwards beyond the center leaf. The table further comprises a table frame, which has a basic body fixed to the center leaf with supporting arms pivot-mounted therein, which are mounted for pivoting into a swung-in first position of support of the center leaf and a swung-out second position of support of a drop leaf. The supporting arms are provided with table-legs.

9 Claims, 8 Drawing Sheets

DROP-LEAF TABLE

BACKGROUND OF THE INVENTION

1. Field of the Invention

The invention relates to a drop-leaf table.

2. Background Art

Drop-leaf tables with tabletops that can be dropped at least partially come in numerous embodiments. There are drop-leaf tables with collapsible frames so that the tabletop is nearly vertical, enabling the tables to be easy to store when folded up.

Further, there are drop-leaf tables with tabletops that can be folded almost vertically by means of a gas spring. The inherently rigid table frames may then be fitted into each other.

Furthermore, drop-leaf tables are known, having a table frame comprised of two supporting arms which are one arranged above the other with a leg attached to each end. These two frame members in the form of an upside down C may be swung into a common plane when the table is folded up or into a vertical position for placement of the table. By means of hinges, two drop leaves are attached to the supporting arm of the greater bow-type frame member. For the table to be set up, the two drop leaves are swung upwards from the vertical into the horizontal position and the smaller bow-type frame member is moved into a position pivoted by 90° as compared to the other frame member. The two drop leaves then rest on the supporting arm of the smaller frame member. This drop-leaf table may not be equipped with castors on its legs because it would tip over in the folded condition.

SUMMARY OF THE INVENTION

It is an object of the invention to embody a drop-leaf table which is easy to install and easy to fold up, standing stably even when folded up.

According to the invention, this object is attained in a drop-leaf table comprising a tabletop, which has a center leaf and at least a drop leaf that is articulated to the center leaf by a hinge and mounted for pivoting into a dropped position and a position that is directed upwards beyond the center leaf; and a table frame, which has a basic body that is fixed to the center leaf; supporting arms that are pivot-mounted on the basic body for pivoting into a swung-in first position supporting the center leaf and into a swung-out second position supporting at least a drop leaf; and table-legs that are arranged in the vicinity of the ends, turned away from the basic body, of the supporting arms. Due to the fact that a center leaf is provided, in vicinity to which the legs are disposed when the table is folded up, the table stands stably even when folded; all the legs of the table may therefore be equipped with castors. Due to the fact that at least one drop leaf may be pivoted upwards beyond its horizontal position, the supporting arms with the legs thereon are easily accessible for the legs to be swung in or out.

The further development, according to which two supporting arms combine to form a pair of supporting arms and are mounted in the basic body by constrained coupling for pivoting in opposite directions, enables the supporting arms and the legs to be swung in and out more easily and ensures that the two supporting arms of a pair of supporting arms can be swung in and out by the same angle.

Use of the invention may be made by special advantage in a table that is embodied by two drop leaves being articulated to the center leaf by hinges that are parallel to each other, it being regularly advantageous for the center leaf and the drop leaves to have the same size and to complete each other to form a square.

For pivoting about a vertical pivot axis, a joining lever is articulated by a pivot bearing to the ends, facing away from the basic body, of the supporting arms of a first table, having a locking element on a free locking end that faces away from the pivot bearing, the locking element being movable into a position of locked linkage to a portion, facing away from the basic body, of a supporting arm of a second table. This reflects an especially advantageous embodiment of an especially simple way of how to link to each other drop-leaf tables according to the invention, chaining them up into larger table units by the aid of the basic idea of the table according to the invention.

Further features, advantages and details of the invention will become apparent from the ensuing description of the invention, taken in conjunction with the drawing.

DESCRIPTION OF THE PREFERRED EMBODIMENT

Figure 1:
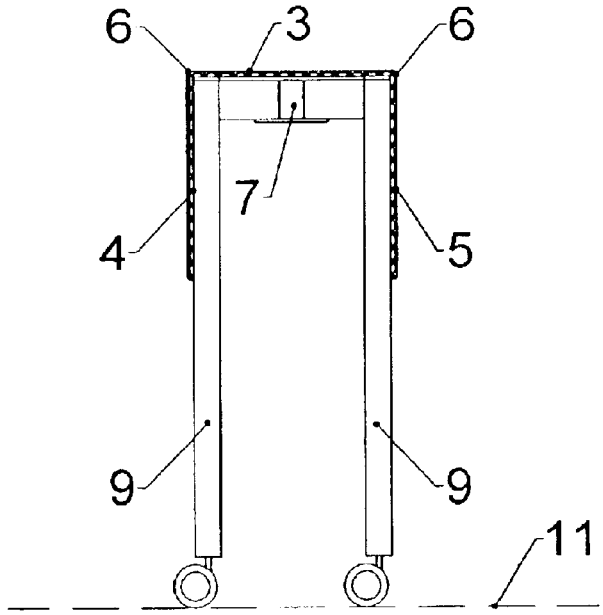
FIG. 1 is a lateral view of a drop-leaf table with two downward drop leaves.

The drop-leaf table seen in FIGS. 1 to 6 comprises a table frame 1 and a tabletop 2 that consists of several pieces. The tabletop 2 is of three-piece design, comprising a center leaf 3 and a first drop leaf 4 and a second drop leaf 5. The drop leaves 4, 5 are joined to the center leaf 3 by a hinge 6 that allows the respective drop leaf 4, 5 to be folded about the horizontal center leaf by distinctly more than 90° and preferably by at least 180° from a vertically dropped position into a preferably vertically upward position beyond the horizontal. The hinges 6 are parallel to each other. In the present case, the center leaf 3 and the drop leaves 4, 5 are of identical size, combining to constitute a square tabletop 2 when set up horizontally.

Figure 2:
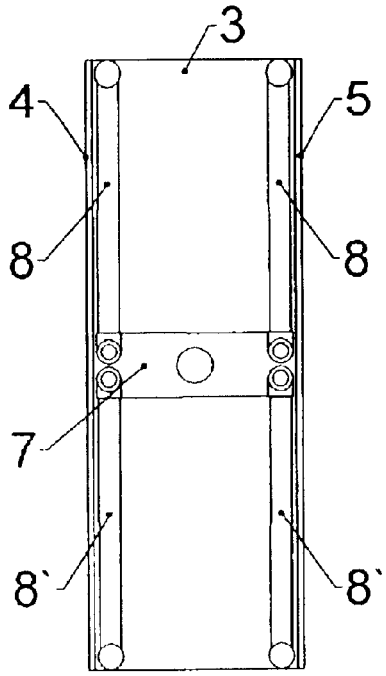
FIG. 2 is a plan view of the drop-leaf table.
Figure 3:
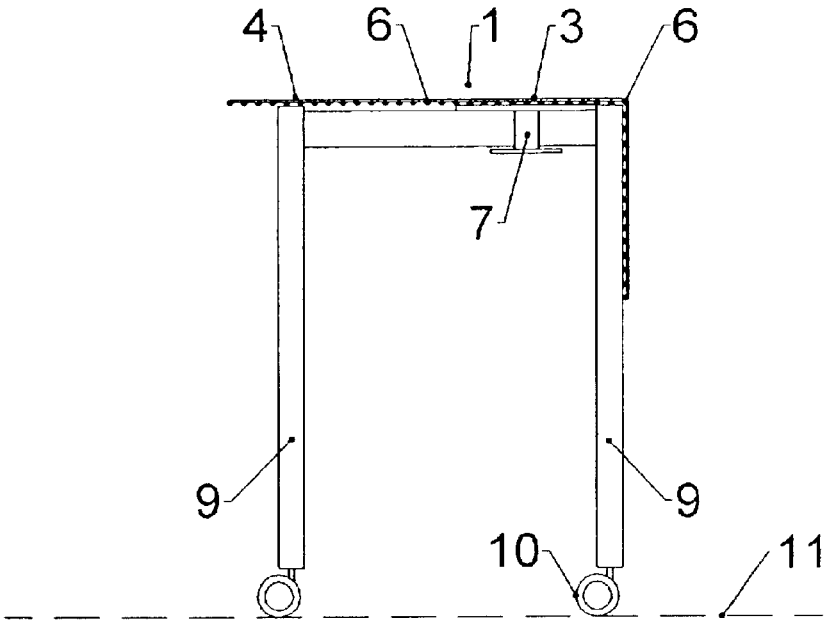
FIG. 3 is a lateral view of the drop-leaf table of FIGS. 1 and 2 with one leaf dropped and one leaf swung up horizontally.
Figure 7:
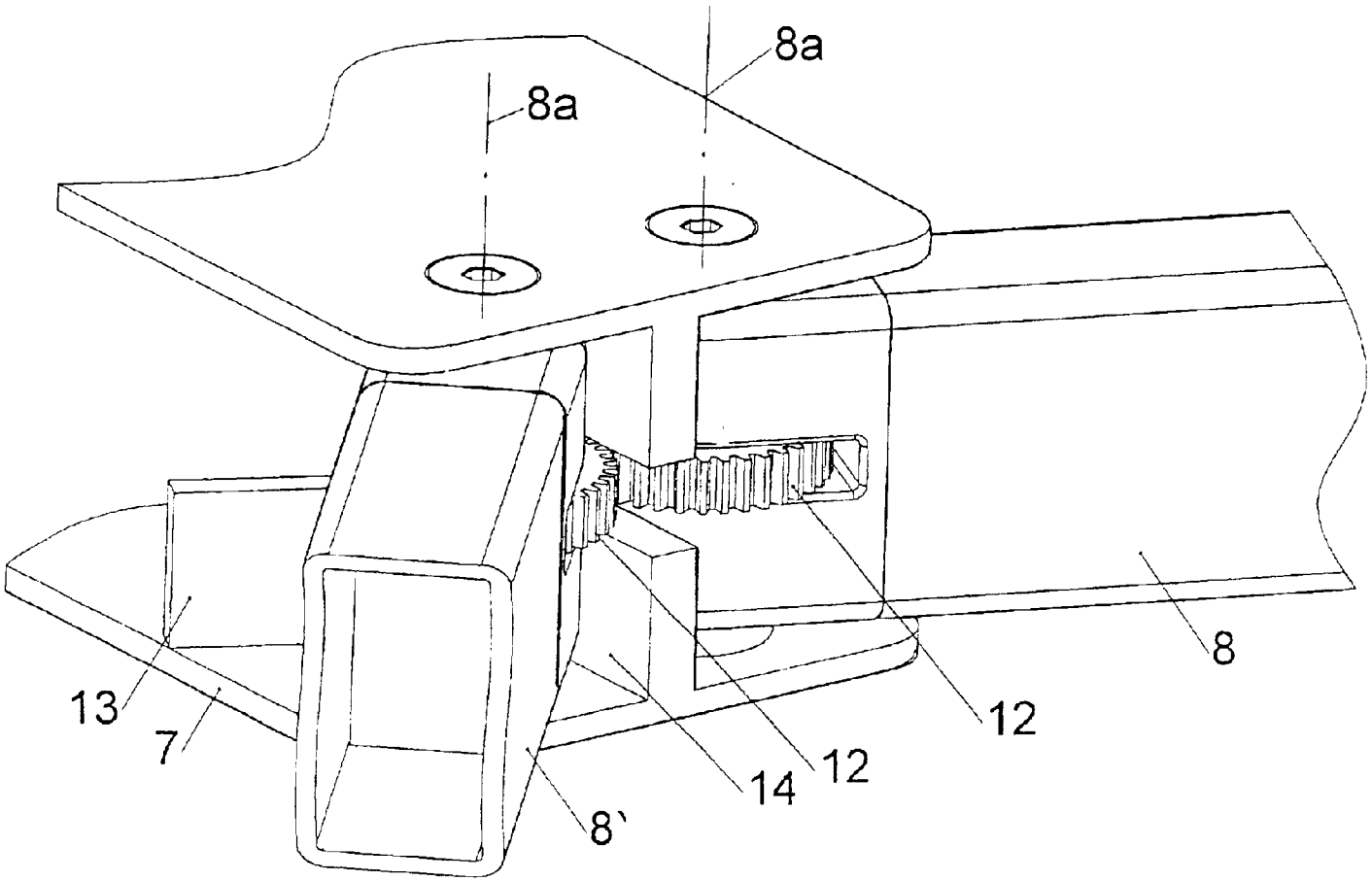
FIG. 7 is a perspective detailed view of a bearing housing of the drop-leaf table with two supporting arms coupled with each other by toothed quadrants.

The table frame 1 comprises a bearing housing 7 mounted on the underside of the center leaf 3 such that it extends substantially over the width thereof as far as into the proximity of the hinges 6. In vicinity to the hinges 6, a pair of supporting arms 8, 8' is mounted in the bearing housing 7 for pivoting about the pivot axes 8*a*, on the end of which that faces away from the bearing housing 7 is mounted a table-leg 9 with the lower end thereof being provided with a castor 10 for the table to support itself on the floor 11. As seen in FIG. 7, the two supporting arms 8, 8' of each pair of supporting arms 8, 8' are coupled with each other via interlocking toothed quadrants 12 so that, upon pivoting of a supporting arm 8 or 8' of a pair of supporting arms 8, 8', the other supporting arm 8 or 8' is pivoted in the opposite direction. A pair of supporting arms 8, 8' at a time is allocated to a drop leaf 4 or 5. If a supporting arm 8 or 8' of the pair of supporting arms 8, 8' seen on the left in FIG. 2 is pivoted from the first position, in which both supporting arms 8, 8' are flush and parallel to the hinge 6, into the second position seen in FIG. 4, in which the supporting arms 8, 8' horizontally support the first drop leaf 4, then the other supporting arm 8' is actuated in the opposite direction but by the same angle. The same is true for the pivoting motion of the supporting arms 8, 8' that are allocated to the second drop leaf 5.

For both drop leaves 4, 5 or only a single drop leaf 4 or 5 to be folded upwards into the position of alignment with the center leaf 3, the respective drop leaf 4 or 5 may be tilted into a vertical position not seen in the drawing, in any case into a position beyond horizontal, in which the respective pair of supporting arms 8, 8' is freely accessible and can be swung out. For limiting the supporting arms 8, 8' in the position of alignment, in which they are swung in under the center leaf 3, and in the position of support underneath a drop leaf 4 or 5, stops 13, 14 are provided, preventing the arms from being swung out beyond these positions.

Figure 8:
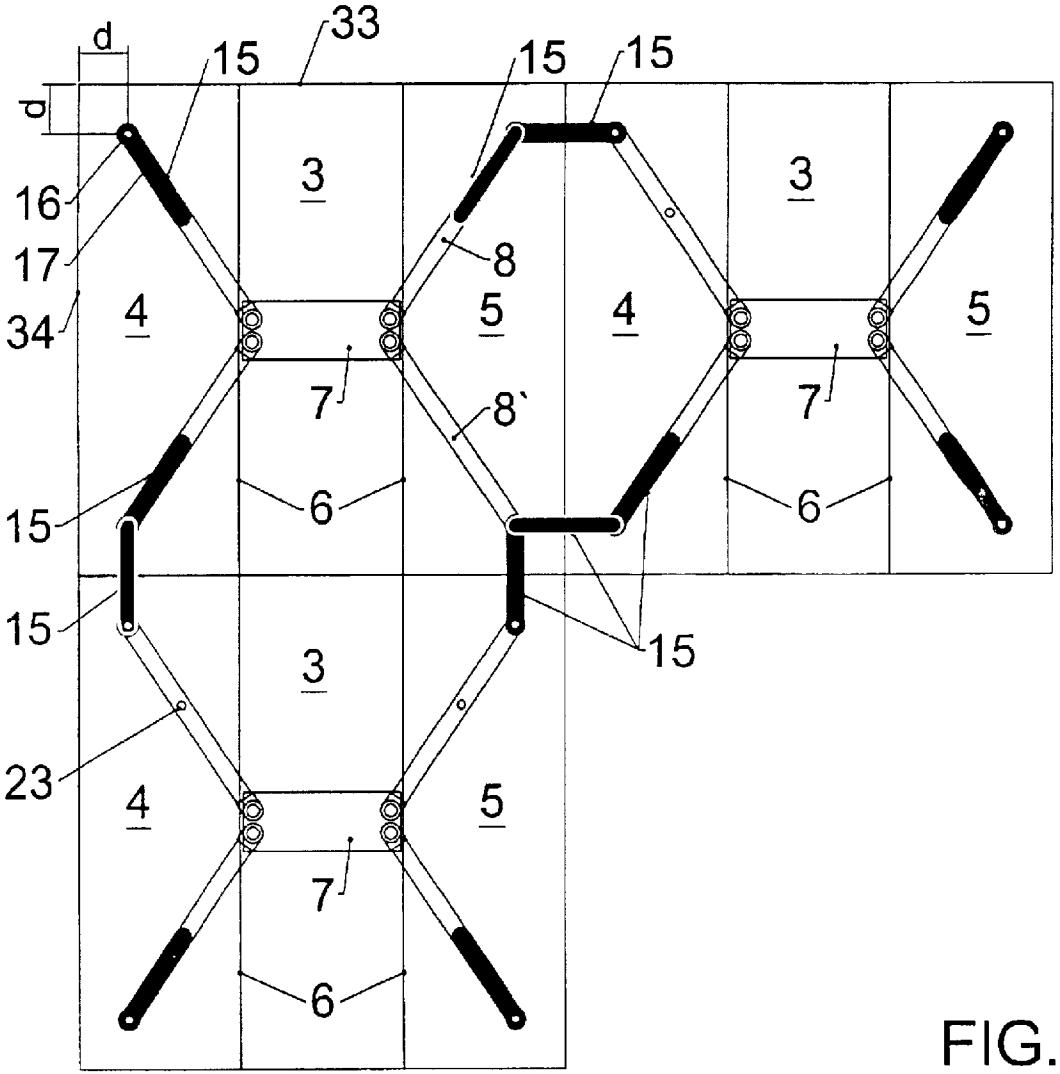
FIG. 8 is a plan view of three drop-leaf tables according to the invention chained to each other.
Figure 9:
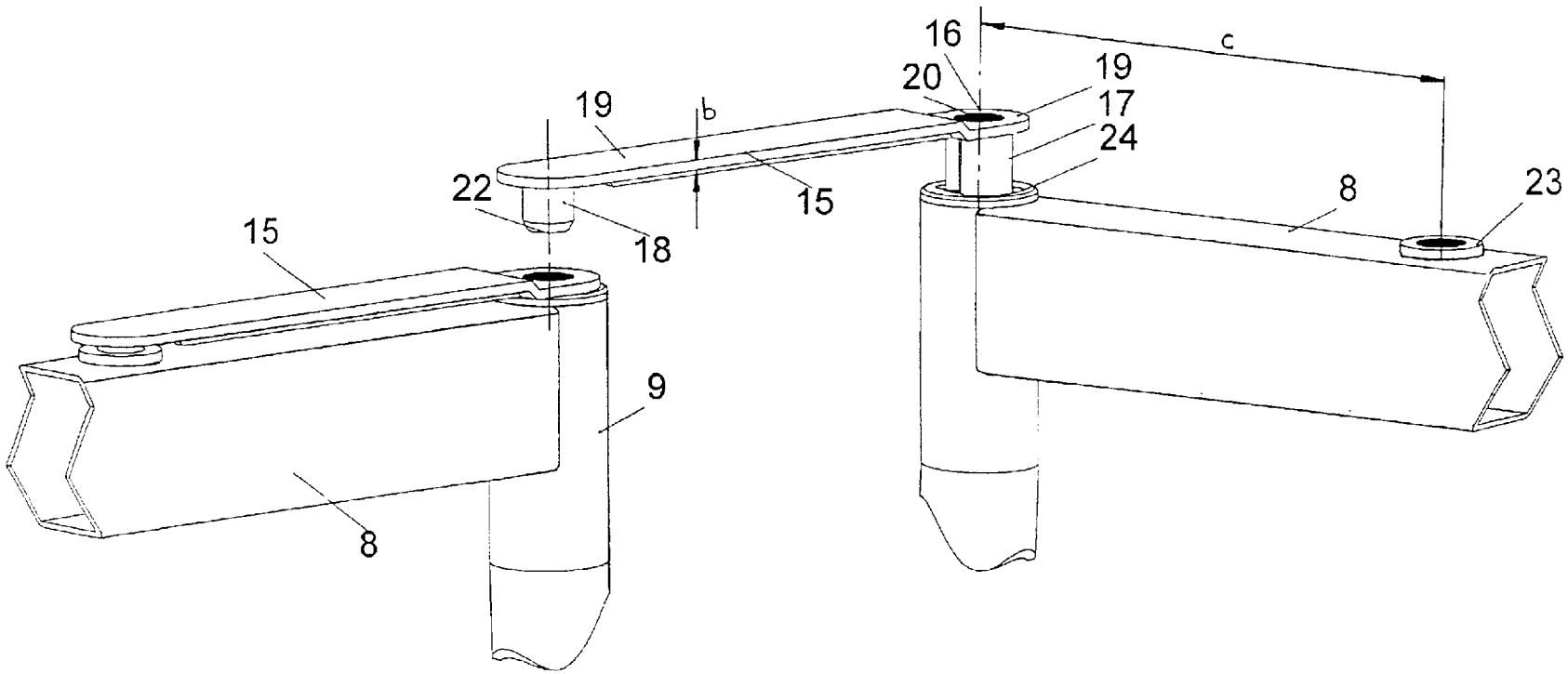
FIG. 9 is a perspective detailed view of the means for chaining two tables.
Figure 10:
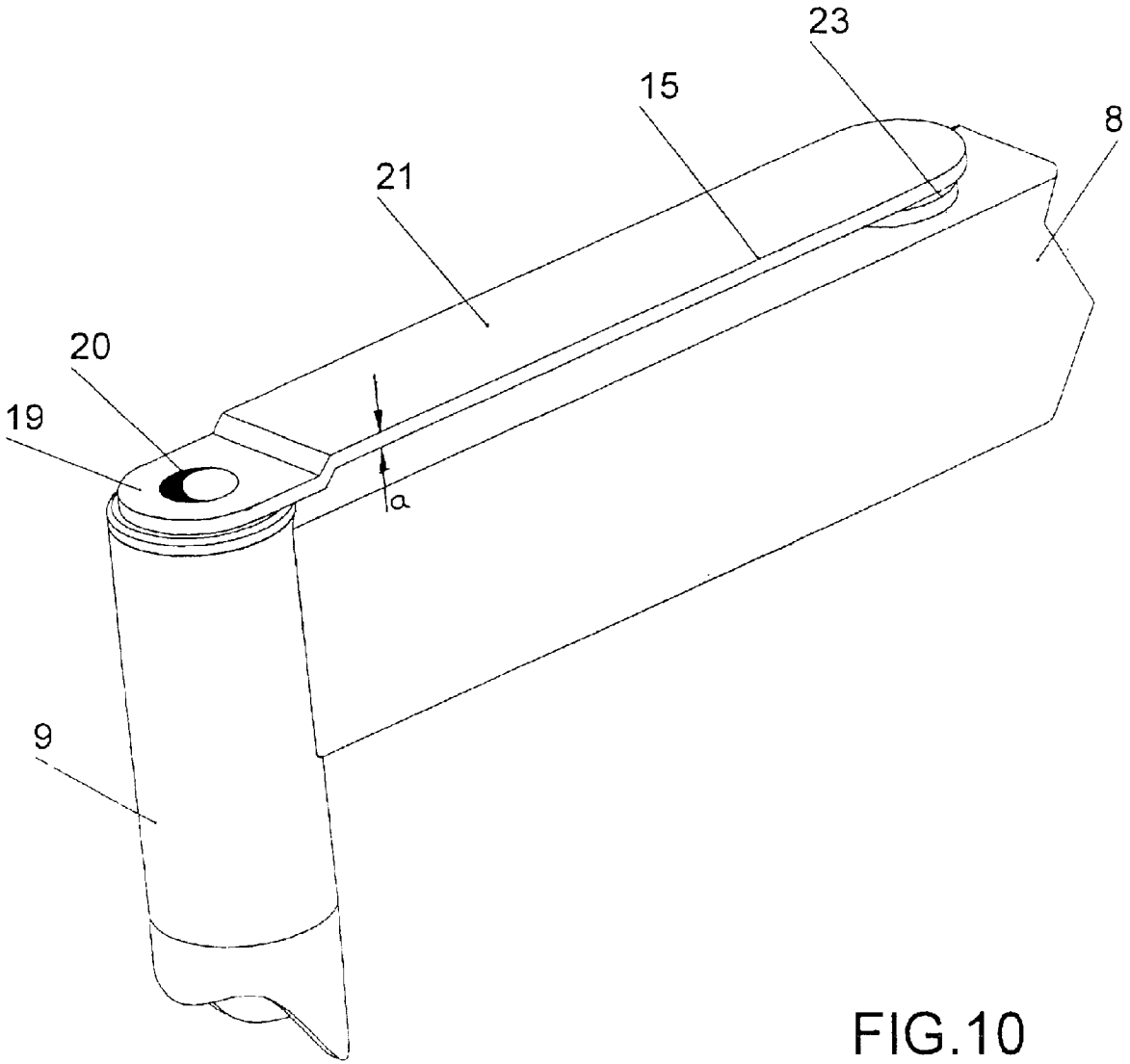
FIG. 10 is a perspective view of another detail of the chaining means.

The tables, the basic design of which has been described, may be linked to each other i.e., several tables may be chained side by side in a row or diagonally as diagrammatically outlined in FIG. 8. To this end, a pivot-mounted joining lever 15 is provided on each end of a supporting arm 8 or 8' i.e., on all the supporting arms 8, 8'. By means of a pivot bearing 17, this lever 15 is mounted for pivoting about a vertical pivot axis 16 at the end of the supporting arm 8 and 8', for instance in the tube that forms a table-leg 9. On its free locking end opposite the pivot bearing 17, the lever 15 has a locking pin 18 that projects downwards. In the vicinity of its pivot bearing 17, the flat lever 15, the vertical thickness of which is small as compared to its width and very small as compared to its length, has a downwardly offset crimp 19, the misalignment a of which corresponding approximately to the vertical thickness b of the lever 15. If the joining lever 15 of the supporting arm 8 of a table is to be joined to a neighboring table—according to the illustration in FIG. 8—then the pin 18 on the free end of the lever 15 may be inserted into a locking opening 20 of the pivot bearing 17 of the other supporting arm, with this free end of the lever 15 lying in the crimp 19 so that the upper sides 21 of the two levers 15 align on a common horizontal plane, serving as a support for the drop leaves 4 and 5 of the two neighboring tables. The vertical pivot axis 16 and the vertical central axis 22 of the pin 18 and of the same lever 15 have a distance c. At this distance c from the pivot axis 16 of a lever 15, provision is made, in the upper side of an associated supporting arm 8 and 8', for a bush 23, on which rests the free end of a joining lever 15 that is not used for linkage to a neighboring table, the locking pin 18 thereof engaging with the bush 23 as seen in FIG. 10. The bush 23 forms an opening for the pin 18. In this position too, the upper side of the joining lever 15 is in alignment with the upper sides 21 of the other joining levers 15 regardless of whether they are swung out or rest on the associated supporting arm 8 and 8'.

Figure 11:
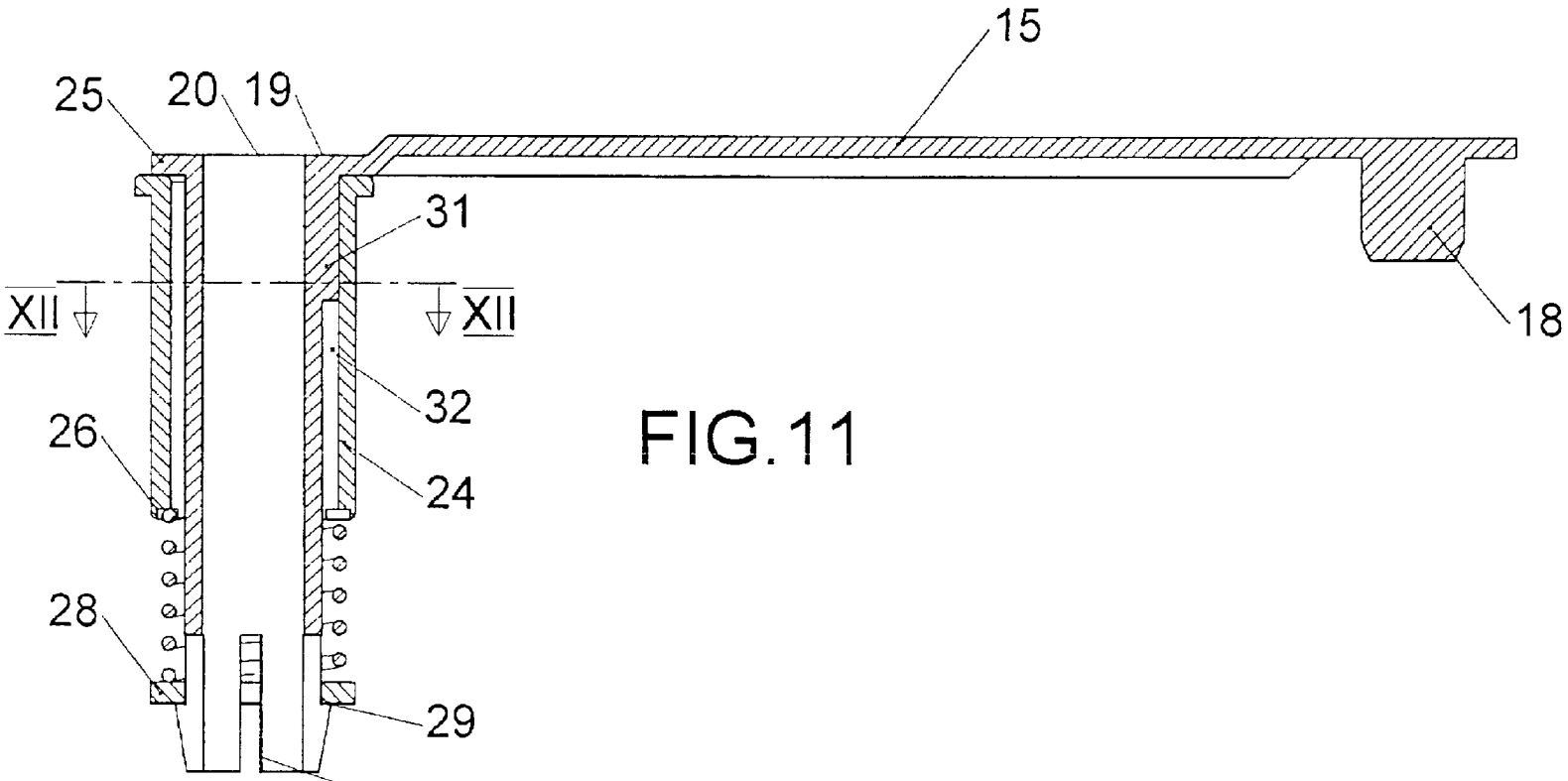
FIG. 11 is an exploded view of a joining lever with a pivot bearing of the chaining means.
Figure 12:
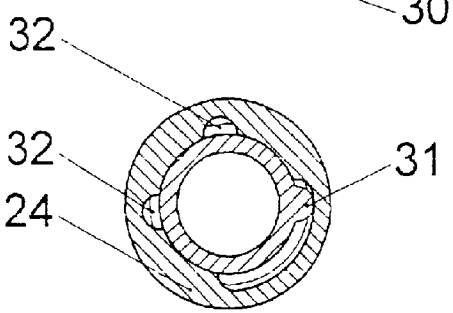
FIG. 12 is a cross-sectional view through FIG. 11 on the line XII—XII of FIG. 11.

FIG. 11 is an exploded view of a joining lever 15 with its pivot bearing 17. The pivot bearing 17 comprises a bearing bush 24 inserted by press-fit into a corresponding opening of the supporting arm 8 and 8' or in particular of the tubular table-leg 9. The crimp 19 bears by its underside on the bearing bush. Mounted on the underside of the crimp 19 of the lever 15 is a hollow bearing journal 25, on the upper end of which is formed the mentioned locking opening 20. An abutment 26 is formed in the bearing bush 24, with a pre-loaded locking spring 27 bearing there-against; the locking spring 27 is a helical spring inserted from below into the bearing bush 24. On the side turned away from the abutment 26, a bearing ring 28 bears from below against the spring 27. On its lower end that is turned away from the crimp 19, the bearing journal 25 has shoulders 29 in the shape of hooks, which may yield inwards towards the pivot axis 16 by flexible deformation of the bearing journal 25 which is provided, in the vicinity of the shoulders 29, with several slits 30 that are parallel to the pivot axis 16. For assembly of the joining lever 16 with the pivot bearing 17, the bearing journal 25 is pushed through the bearing bush 24, the spring 27 is pushed from below into the bearing bush 24 against the abutment 26, and then the bearing ring 28 is pushed over the shoulders 29 until it locks into place behind the shoulders 29, simultaneously pre-loading the spring 27. The bearing journal 25 consisting of flexible plastic material, this can be done without any difficulties. After this pre-assembly of the joining lever 15 with its pivot bearing 17, the bearing bush 24 is inserted by press-fit into the supporting arm 8 or 8' or preferably into the table-leg 9.

For chaining tables to each other as specified above, the joining lever, which is in its position of rest seen in FIG. 10, is lifted upwards, while the locking spring 27 is further loaded, so that the locking pin is pulled out the bush 23; then the lever 15 is swung around into another position and inserted into the locking opening 20 of the joining lever 15 of a neighboring table. Due to the fact that the joining lever 15, in any position, is loaded by downward restoring force towards the supporting arm 8 or 8', there is no risk of the connection of two tables inadvertently disengaging even without a drop leaf 4, 5 resting thereon.

As seen in FIG. 11, a rib 31 that stands out externally is formed on the bearing journal 25 in the vicinity of the crimp 19, this rib 31 being free from the bearing bush 24 when it is pulled out the joining lever 15 for the joining lever 15 to pivot freely. Upon re-insertion of the bearing journal 25 into the bearing bush 24 counter to the restoring force of the locking spring 27, the rib 31 may engage only with one of the recesses formed in the upper region of the bearing bush 24. These recesses 32 are formed in positions that correspond to the given positions of the joining lever 15. The rib 31 cooperates with the recesses 32, forming various safeguards against rotation of the joining lever 15 relative to the supporting arm 8 and 8'.

Figure 4:
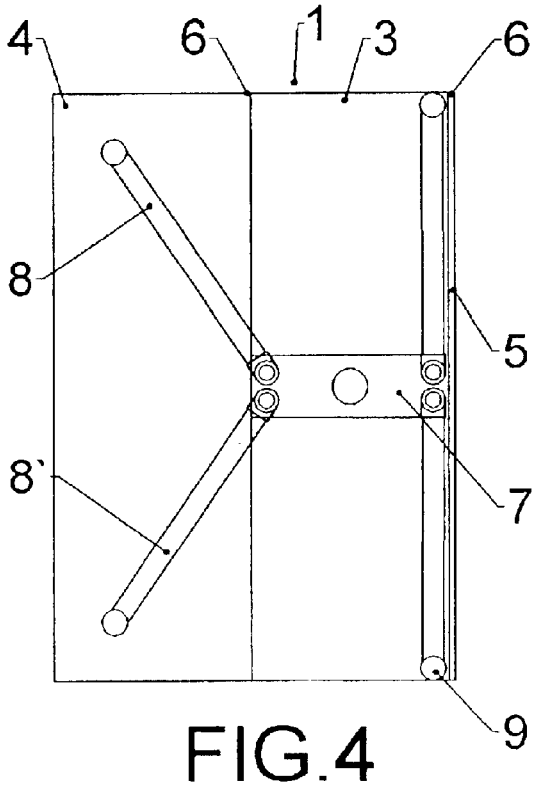
FIG. 4 is a plan view of the drop-leaf table of FIG. 3.
Figure 5:
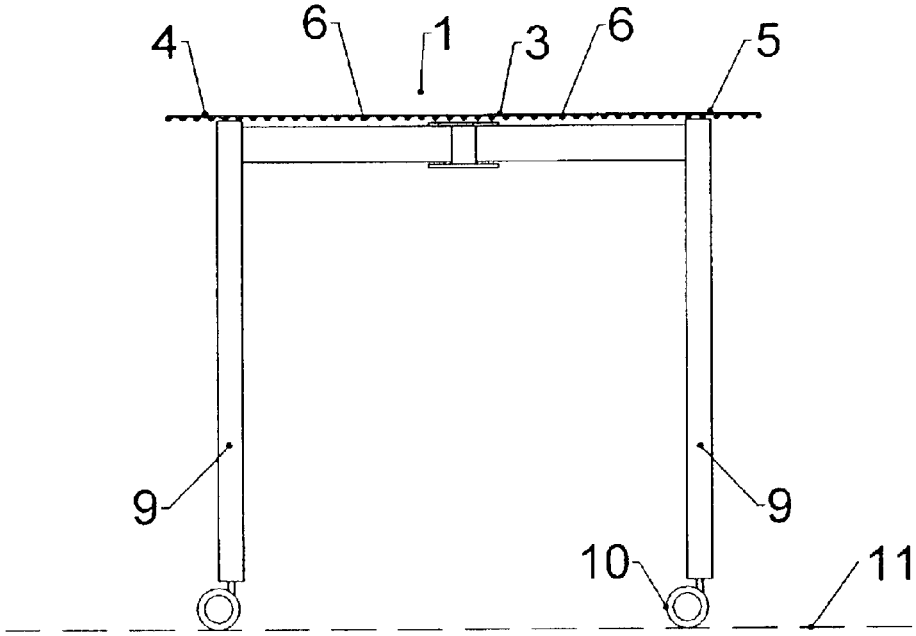
FIG. 5 is a lateral view of the drop-leaf table of FIGS. 1 to 4 with two leaves swung up horizontally.
Figure 6:
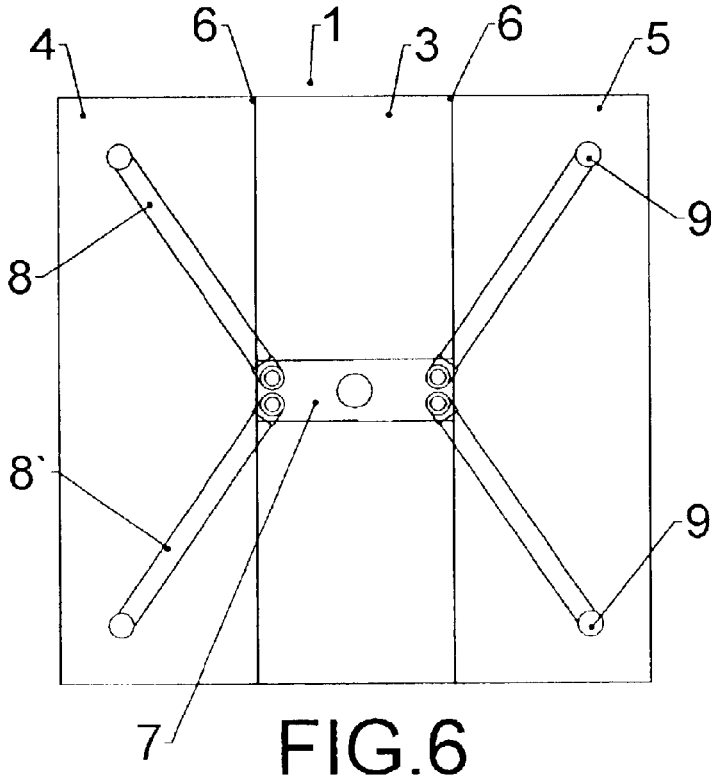
FIG. 6 is a plan view of the drop-leaf table of FIG. 5.

As seen in FIGS. 4, 6 and in particular 8, when the supporting arms 8, 8' are swung out, the pivot axis 16 of the pivot bearing 17 is at the same distance d from the two perpendicular outer edges 33 and 34 of the tabletop 2 so that, for chaining two neighboring tables to each other, it is of no importance whether the center leaf 3 and the drop leaves 4, 5 of neighboring tables are parallel or perpendicular to each other and consequently whether the hinges 6 of two neighboring tables are parallel or perpendicular one relative to the other.

What is claimed is:

1. A drop-leaf table, comprising a tabletop (2), which has a center leaf (3) and at least a drop leaf (4,5), which is articulated to the center leaf (3) by a hinge (6) and mounted for pivoting into a dropped position and a position that is directed upwards beyond the center leaf (3), and a table frame (1), which has a basic body (7) that is fixed to the center leaf (3), supporting arms (8, 8') that have ends turned away from the basic body (7) and are pivot-mounted on the basic body (7) for pivoting into a swung-in first position supporting the center leaf (3) and into a swung-out second position supporting at least a drop leaf (4,5), and table-legs (9) that are arranged in the vicinity of said ends of the supporting arms (8, 8').

wherein, for pivoting about a vertical pivot axis (16), a joining lever (15) is articulated by a pivot bearing (17) to the ends, facing away from the basic body (7), of the supporting arms (8, 8') of a first table, having a locking element (18) on a free locking end that faces away from the pivot bearing (17), the locking element (18) being movable into a position of locked linkage to a portion, facing away from the basic body (7), of a supporting arm (8, 8') of a second table.

2. A drop-leaf table according to claim 1, wherein said supporting arms (8, 8') combine to form a pair of supporting arms (8, 8') and are mounted in the basic body (7) by constrained coupling for pivoting in opposite directions.

3. A drop-leaf table according to claim 1, wherein two drop leaves (4,5) are articulated to the center leaf (3) by hinges (6) that are parallel to each other.

4. A drop-leaf table according to claim 1, wherein the joining lever (15) is mounted in the pivot bearing (17) for displacement in the direction of the pivot axis (16).

5. A drop-leaf table according to claim 4, wherein the joining lever (15) is movable upwards in relation to the pivot bearing (17) counter to the restoring force of a locking spring (27).

6. A drop-leaf table according to claim 1, wherein the joining lever (15) comprises, as a locking element, a locking pin (18) and, in a vicinity of the pivot bearing (17), a locking opening (20) that is adapted to receive the locking pin (18).

7. A drop-leaf table according to claim 1, wherein the joining lever (15) in a vicinity of the pivot bearing (17), is provided with a crimp (19) that serves to take up the locking end of another joining lever (15).

8. A drop-leaf table according to claim 1, wherein an opening (23) is provided in each supporting arm (8, 8'), taking up the locking element (18) when the joining lever (15) is in a position directly above the supporting arm (8, 8').

9. A drop-leaf table according to claim 1, wherein the pivot bearing (17) is arranged inside the table-leg (9).

* * * * *